United States Patent [19]

Joyce

[11] Patent Number: 4,503,991

[45] Date of Patent: Mar. 12, 1985

[54] TWO PART SNAP HINGE

[76] Inventor: Michael Joyce, 287 Smoke Rise Rd., Kinnelon, N.J. 07405

[21] Appl. No.: 568,623

[22] Filed: Jan. 6, 1984

[51] Int. Cl.[3] ..... B65D 43/14; B65D 51/04

[52] U.S. Cl. ..... 220/339; 220/335; 16/225; 16/227; 16/DIG. 13; 222/517; 222/498; 215/235; 215/237; 229/44 R

[58] Field of Search ..... 220/335, 337, 339; 16/293, 225, 227, DIG. 13; 215/216, 224, 235, 237; 24/137 R, 137 A, 252 R, 252 A; 222/517, 498; 229/44 R

[56] References Cited

U.S. PATENT DOCUMENTS

| | | | |
|---|---|---|---|
| Re. 30,861 | 2/1982 | Krawagna | 16/293 |
| 3,289,877 | 12/1966 | Wolf | 16/225 |
| 3,628,215 | 12/1971 | Everburg | 16/293 |
| 3,760,972 | 9/1973 | McKirnan | 220/9 R |
| 3,881,639 | 5/1975 | Herip | 222/498 |
| 4,095,712 | 6/1978 | Perrella | 220/339 |
| 4,158,902 | 6/1979 | Chernack et al. | 16/227 |
| 4,358,032 | 11/1982 | Libit | 222/498 |
| 4,371,095 | 2/1983 | Montgomery | 215/235 |
| 4,403,712 | 9/1983 | Wiesinger | 220/339 |
| 4,414,705 | 11/1983 | Ostrowsky | 16/225 |

*Primary Examiner*—George T. Hall

*Attorney, Agent, or Firm*—Lerner, David, Littenberg, Krumholz & Mentlik

[57] ABSTRACT

A biasing hinge is disclosed which is made up of a first hinge member and a second hinge member integrally hinged together along a curved line. The hinge members are shaped so that when one hinge member is swung relative to the other, the members are resiliently deformed or stressed and energy is stored in said hinge members. This stored energy will bias the hinge members to swing to an open or a closed position depending on which position is nearest said hinge member at a particular time. The hinge can be molded with the hinge members having the desired shape to provide the necessary stresses to provide the desired biasing. The hinge can also be molded as an integral part of a cap or closure.

19 Claims, 30 Drawing Figures

TWO PART SNAP HINGE

BACKGROUND OF INVENTION

This invention relates to an improved biasing or snap hinge preferably made of two thermoplastic parts connected together by an integral hinge.

One of the most significant design innovations made possible by the introduction of plastic materials was the concept of the integral hinge, sometimes referred to as the living hinge or film hinge. The integral hinge has been molded into a wide variety of products ranging from small bottle caps and jewelry boxes to large complex closures and housings. Hinges with one part biased toward either of two positions are also well known in the art. However, all of these biased hinges require a spring to achieve the snap or biasing action in addition to the two hinge members themselves.

SHORT STATEMENT OF THE INVENTION

The present invention involves a snap or bias action hinge consisting of two plate like hinge parts integrally connected together by an integral hinge. Integral hinges are well known in the art but such hinges have traditionally required a spring to produce the spring action. Applicant's hinge consists of two hinge members hinged together along a curved line. At least one of said hinge members being adapted to be distorted by the other hinge member when the hinge members are swung from a first position to a second position. The hinge members are thus biased toward the first position or the second position depending on which is nearest at a particular time. When the hinge member is moved further, the energy is released thereby giving a biasing force and eliminating the need of the spring yet retaining its function.

The oil can principle is common in mechanic's oil cans wherein the oil can bottom is domed or bowed outward at its center. To dispense oil, the mechanic presses the bow with his thumb forcing it through a flat configuration to a reverse bowed position and thus reducing the volume of the oil can forcing the oil out. When the thumb pressure is released, the internal forces stored in the distorted can bottom spring it back to its arched position. Applicant has applied the oil can principle to his hinge by providing a deformation in one of the hinge members to change its shape so that it transfers energy to the other hinge member and the hinge members are biased by the released energy toward the stable position nearest it. Thus the internal stress of the hinges functions as a spring, biasing the hinge members to one or the other stable position. The hinge may be made from any resilient thermoplastic material, for example, polypropylene, polyethylene, polystyrene or any similar polymer. It could also be made of a flexible thermoset material such as urethane or flexible thermoset rubber.

REFERENCE TO PRIOR ART

U.S. Pat. Nos. 4,414,705 and 3,289,877 are examples of snap action hinges typical of the prior art. The '705 Patent is an example of a snap type or biasing hinge typical of the prior art which requires a third spring member to introduce the snap or biasing action to the hinge in addition to the two hinge plate members.

U.S. Pat. No. 3,545,034 shows a hinge with two conventional parts connected by a hinge pin that is in the form of a bowed spring wire.

U.S. Pat. No. 3,760,972 discloses a container with a cover having a captive door which is operable in response to pressure on the cover. The cover is capable of only limited excursion of movement and is vulnerable to damage.

U.S. Pat. No. 4,095,712 discloses a container and lid with an opening closed by a flap formed integral with the remaining part of the lid. The lid is elastically deformable and is moved from a closed position to an open position in response to pressure on a minor part of the lid. A disadvantage of this hinge is the added complexity of the lid as well as the additional complexity, cost of manufacture and inherent lack of uniformity of function and reliability.

OBJECTS OF THE INVENTION

It is an object of the invention to provide an improved two part snap type hinge.

Another object of the invention is to provide a snap type hinge made of two parts integrally molded together which is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF DRAWING

DETAILED DESCRIPTION OF DRAWING

Figure 1:
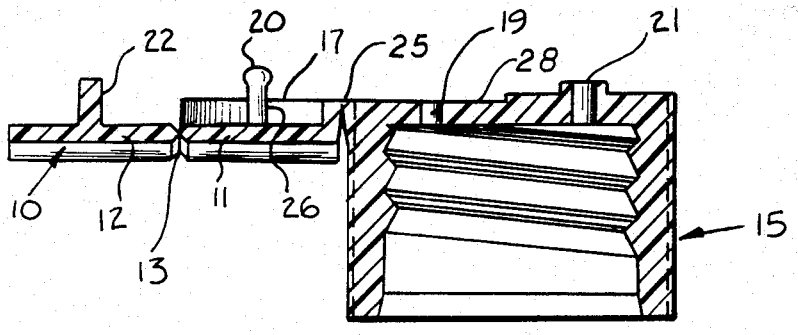
FIG. 1 is a longitudinal cross sectional view of a hinge according to the invention used in combination with a two piece closure taken on line 1—1 of FIG. 2.

Now with more particular reference to the embodiments of the invention, several examples of the application and function of the two-part hinge according to the invention are shown.

In FIGS. 1 through 6, Applicant show a closure 15 having a cylindrical side wall and a top 28 with a flat top surface. The closure may be internally threaded to be supported on the threaded neck of a bottle. The top has a dispensing opening 21 and a pintle receiving opening 19.

The lid 10 of the closure has a pintle 26 integrally formed thereon with a head 20. When the first hinge part 11 is swung to the position shown in FIGS. 3, 5 and 6, the pintle 26 enters the opening 19 and the head 20 is forced through the opening, and being made of a resilient material the head returns to its original size after passing through the opening 19 to hold the pintle 26 preventing the pintle from withdrawal. The pintle 26 is sufficiently short that when it is pushed through the opening 19 to move the head 20 below the bottom of the top 28, the lid member 11 is bowed downward to conform generally to a part of a cylinder as shown in FIG. 6. The hinge member 11 has a peripheral flange 17 which rests on the top 28 when the first hinge member is swung to the position shown in FIGS. 3, 5 and 6. The head 20 will underlie the top 28 and hold the first hinge member 11 in bowed or distorted relation, bowed about a radius that is perpendicular to the top surface of the plate-like member 11. The first hinge member 11 is swingably attached to the closure 15 by integral hinge 25 and the second hinge member 12 is hinged to the first hinge member 11 by the integral hinge 13. The edge of the second hinge member 12 attached to hinge 13 will be bowed or distorted due to the force exerted on it by a force transferred to the first hinge member 11 due to the bow shown in FIG. 6. The force exerted on the second hinge member 12 by first hinge member 11 will distort and bias it toward the position shown in FIG. 3. Should the member 12 be moved manually further from the position shown in FIG. 3, the distortion in the first hinge member 11 will tend to be straightened as the second hinge member 12 is moved toward the position shown in FIGS. 5 and 6. At the position shown in FIGS. 5 and 6 the second hinge member 12 will be disposed generally at right angles to the first hinge member 11, and the beam action of the hinge member 12 will tend to straighten the hinge member 11, and at the same time warp member 12 thereby exerting a balanced force which will not tend to bias the member 12. The stresses on the member 12 will distort it or warp it somewhat in the shape of the configuration shown in FIG. 4 when viewed from above. When the member 12 is swung further toward the closed position of FIG. 3, the biasing force tending to straighten the warped shape of the member 12 will exert a biasing force which will tend to swing the member 12 to the open position.

Figure 3:
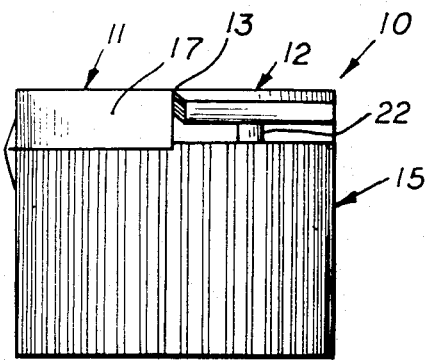
FIG. 3 is a side view of the closure, shown in FIGS. 1 through 6 with lid closed.
Figure 4:
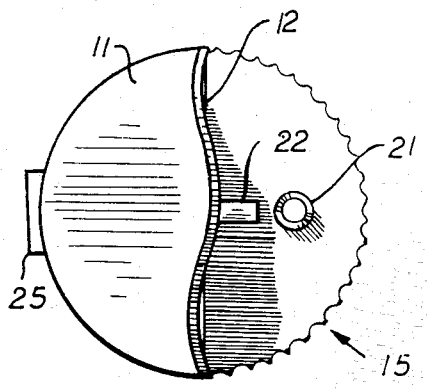
FIG. 4 is a top view FIG. 5.
Figure 5:
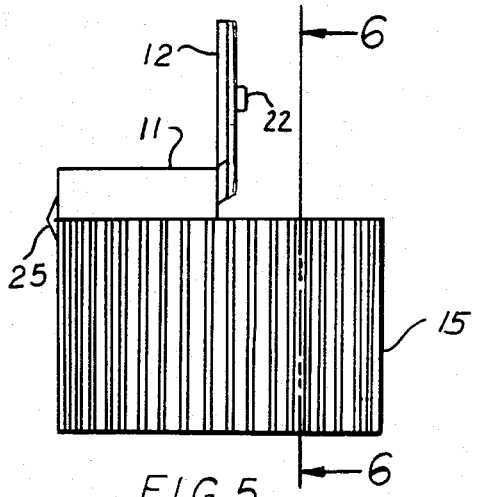
FIG. 5 is a side view of the closure shown in FIGS. 1 through 4 with lid open.
Figure 6:
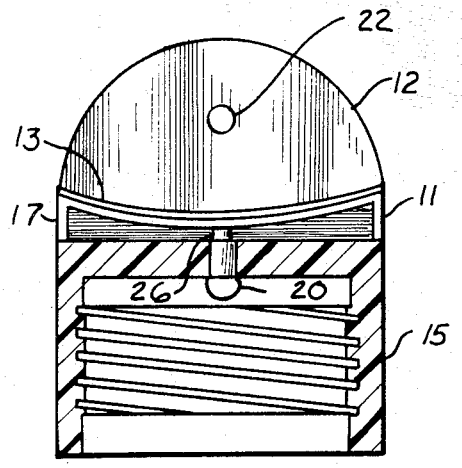
FIG. 6 is a cross sectional view taken on line 6—6 of FIG. 5.

Therefore the second hinge member or lid member 12 will be biased toward the closed position shown in FIG. 3 when it is moved beyond the position shown in FIG. 5 toward closed position and the pin 22 will block the dispensing opening 21.

When it is desired to dispense material through the opening 21, the lid member 12 will be swung beyond the position of FIG. 5 and it will be biased toward the fully open position 180° from the position shown in FIG. 3 by the internal forces stored in the resilient material making up the hinge members 11 and 12, and in the position 180° from the position shown in FIG. 3, the hinge member 11 will have a reverse curvature to the curvature it has when in the position shown in FIG. 6.

Figure 2:
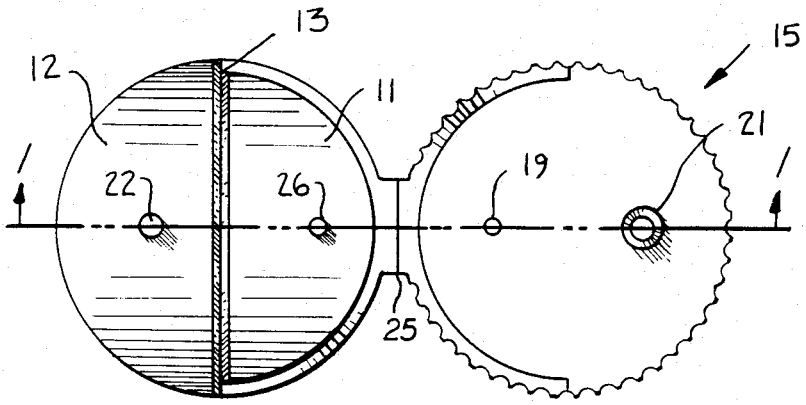
FIG. 2 is a top view of the hinge and closure according to the invention with the lid in position as molded.

The closure can be molded in a two piece mold in the position shown in FIGS. 1 and 2. The necessary bow to bias the top will be formed when lid member 11 is closed to the position shown in FIGS. 3, 5 and 6. In that position pintle 26 will hold lid member 11 in the shape of a part of a cylinder.

Figure 8:
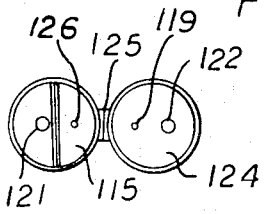
FIG. 8 is a top view of the hinge with the closure and lid in position to be molded.
Figure 9:
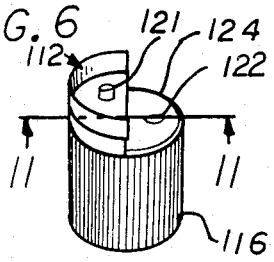
FIG. 9 is an isometric view of the closure shown in FIGS. 6 through 11 with the second lid member in an open position.
Figure 10:
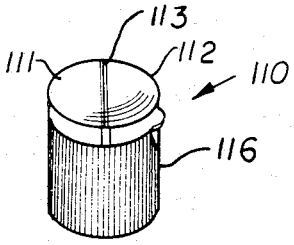
FIG. 10 is an isometric view of FIGS. 7, 8 and 9 with both lid members closed.
Figure 11:
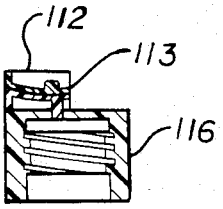
FIG. 11 is a cross sectional view taken on line 11—11 of FIG. 9.

Now with specific reference to the embodiment of the invention shown in FIGS. 7 through 11, Applicant shows the hinge according to the invention applied to the lid 110 of a closure 116. The closure 116 has a generally flat top 124 with a dispensing opening 122 and a pintle receiving opening 119 in it. The closure 116 may be internally threaded. The first lid member 111 is swingably connected to the closure 116 by means of an integral lid 125. The lid 110 is made up of the first lid member 111 and the second lid member 112. Each of these lid members 111 and 112 has a peripheral downwardly extending flange and the lid members are concave as best shown in FIG. 10. When the first lid member 111 is swung to the position shown in FIG. 10, the pintle 126 is received in the hole 119 and it will hold the first lid member 111 in the position shown in FIGS. 9 and 10. When lid member 112 is in the position shown in FIGS. 9 and 11, a stress will be introduced between the lid members 111 and 112, due to the distortion of lid member 111, biasing the lid member 111 toward the open position shown in FIG. 9 or FIG. 10. Pintle 126 will bias the lid member 111 to a greater curvature than the curvature of member 112 therefore the bias function will be like that of FIGS. 1 through 6.

If the lid member 112 is swung from the position shown in FIG. 9 toward the position shown in FIG. 10, when it passes the vertical position it will be distorted by the lid member 111 which will bias the lid member 112 toward the closed position shown in FIG. 10.

A suitable latch 130 can be provided for the lid member 111, of a type familiar to those skilled in the art, to hold it in the fully closed position shown in FIG. 10.

Figure 12:
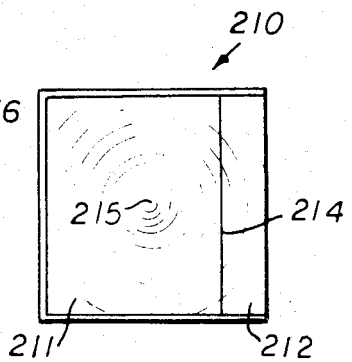
FIG. 12 is a top view of the embodiment of the invention shown in FIGS. 12 through 14 showing the hinge members bowed to conform to a section of a sphere.
Figure 13:
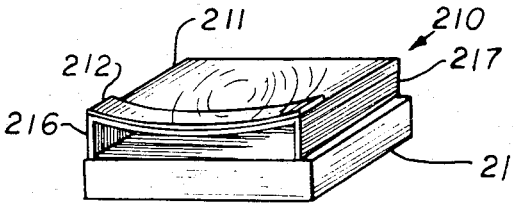
FIG. 13 is a front isometric view of the hinge shown in FIG. 12 with the second hinge member swung to a position 180° from the position of FIG. 12.
Figure 14:
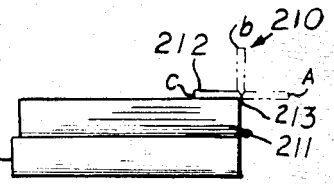
FIG. 14 is a side view of the hinge of FIGS. 12 through 14.
Figure 15:
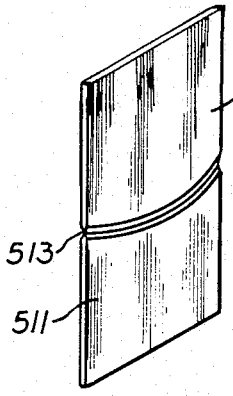
FIG. 15 is a side isometric view of the embodiment of the hinge shown in FIGS. 15 through 18.
Figure 16:
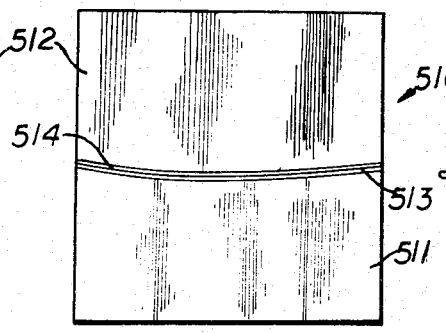
FIG. 16 is a front isometric view of the hinge of FIG. 15 with one hinge member swung to a position 90° from the position of FIG. 17.

Now with more specific reference to the embodiment of the invention shown in FIGS. 12, 13 and 14, Applicant shows another embodiment of the invention wherein a hinge 210 having first hinge member 211 and second hinge member 212 swingably connected together by an integral hinge 213 to swing from the position A shown in FIG. 14 through the position B to the position C. The plate like hinge members are molded in a distorted position which is shown as being a concave surface in the form of a part of a sphere having a radius perpendicular to hinge member 211. The operation of the hinge member 212 and the hinge member 211 is similar to the corresponding operation of the corresponding parts in FIGS. 1 through 6. When the hinge member 212 is in the molding position of FIG. 12, there will be no stress in the hinge members. When member 212 is swung to the position shown in full lines in FIG. 14, the hinge member 212 will be forced into the form of a curve reversed to that shown in FIG. 12, thus the stresses introduced in the two hinged members during this swinging movement will be analogous to those introduced in the hinge member in the first two described embodiments of the invention, and the hinge member 212 will be biased from the intermediate position B toward the position C or toward the position A, depending on which side of the intermediate position B it happens to be at a particular time.

Figure 19:
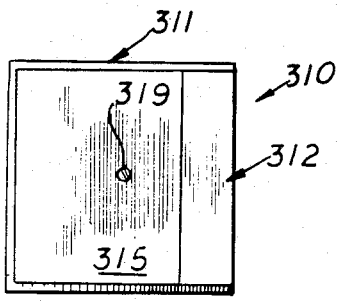
FIG. 19 is a top view of the embodiment of the hinge of FIGS. 19 through 21 with hinge members in molding position.
Figure 20:
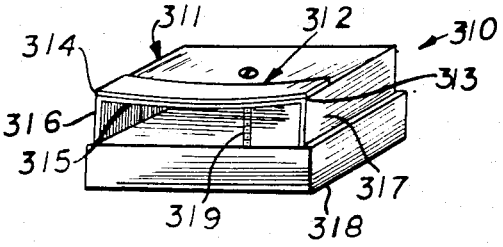
FIG. 20 is an isometric view of the embodiment of the hinge shown in FIG. 19 through 21 with the second hinge member swung to a position 180° from the position shown in FIG. 19.
Figure 21:
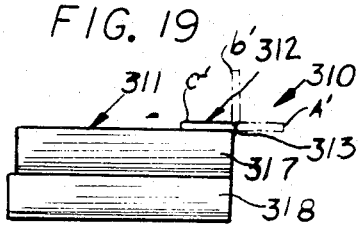
FIG. 21 is a side view of the embodiment of FIGS. 19, 20 and 21 showing the second hinge member swung 180° to the position shown in FIG. 20.

Now with more particular reference to the embodiment of the invention shown in FIGS. 19 through 21, which show by way of illustration a hinge member 310 having downward extending flanges 316 and 317 supported on a base 318. The plate like hinge members 311 and 312 may be molded flat and member 311 is bowed downward toward the base 318 by screw 319, thereby bowing the top surface of plate like hinge member 311 into substantially the shape of a part of a cylinder having a radius of curvature perpendicular to the hinge member 311. It will be noted in FIG. 19 that the second hinge member 312 is forced by member 311 into a bow that is conformed to the surface of the hinge member 311 when in the molding position.

Figure 24:
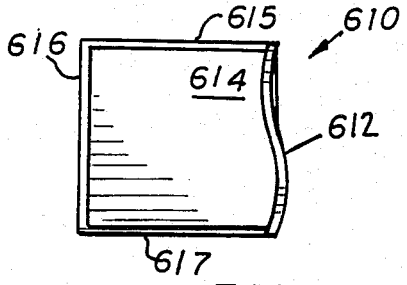
FIG. 24 is a top view of the embodiment of the FIGS. 22 through 25.

When the hinge member 312 swings through the intermediate position b′ in FIG. 21 to the right hand position c′ in FIG. 21, in the intermediate position hinge member 312 will be distorted to a warped shape like FIG. 24. As the member 312 is swung toward the position of FIG. 20 the member 312 will be curved in the opposite direction from the radius of the curve the hinge member 312 has in the position shown in FIG. 20. Thus when the hinge member 312 swings from a position shown in FIG. 19 to the position shown in FIG. 20, the hinge member will be biased toward the position on that side of the intermediate position. That is the hinge will be biased to swing open and to swing closed depending on the side of the neutral position b′ at a particular time.

Figure 7:
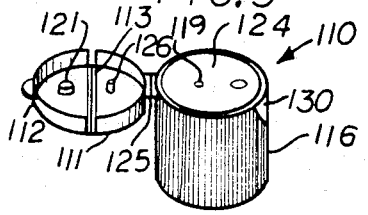
FIG. 7 is an isometric view of the embodiment of the closure of FIGS. 7, 8, 9, 10 and 11 with the lid in the position to be molded.

The closure can be molded in one piece in the position shown in FIGS. 7 and 8 in a two pice mold. The lid will have a concave top with a curved hinge line as shown and the upper surface of the lid will be curved so that the hinge line 113 is curved.

Figure 25:
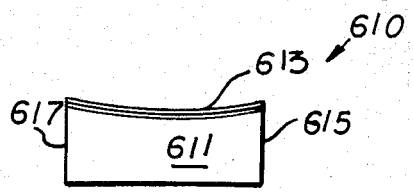
FIG. 25 is an end view of the box of FIG. 22 and FIG. 23 with the cover which acts as a second hinge member swung 180° from the position shown in FIG. 27.

In the embodiment of the invention shown in FIGS. 22, 23, 24 and 25, Applicant shows another embodiment of the hinge 610 wherein the first hinge member 611 is molded with one end bowed about a radius of curvature parallel to the surface of the second hinge member 611 and top 612 will be molded in the shape of a part of a cylinder. The hinge line is curved due to the curved top of back 611. The container shown has a bottom 614, a flat top 612 comprising the second hinge member which is molded with a partial cylinder shaped bow in the molding position shown in FIG. 22, and flat front 616 and back 611 having a curved top. The top edge of the back 611 is curved or bowed about a radius extending generally parallel to the plate like back member 611. The bowed top 612 has a straight edge attached to the curved top edge of the back 611 as best shown in FIG. 25. Back 611 is connected to top 612 by hinge 613 which swingably connects the first hinge member represented by back 611 by the integral hinge 613 to second hinge member or top 612. When the back 611 is in the position shown in FIG. 22, it is in molding position and introduces no stress into the member 612. When the second hinge member 612 is swung to a position shown in FIG. 25 a stress will be introduced between the hinge members because of member 612 with its straight end swinging on the curved end of member 611. This stress will bias the top toward open position. The stresses introduced in the hinge members in their swinging movement around their curved hinge line distorts them as indicated in top view 24 when the lid 612 is in the intermediate position shown in FIG. 23 will tend to bias the top 612 either toward the open position shown in FIG. 22 or the closed position shown in FIG. 25 depending on which side of the shown in FIG. 23 the member 612 is in at the particular time. Thus the top will be biased to swing open or to swing closed.

Figure 22:
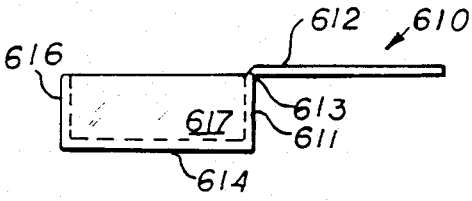
FIG. 22 is a side view of another embodiment of the invention shown in molding position of a box and hinged lid.
Figure 23:
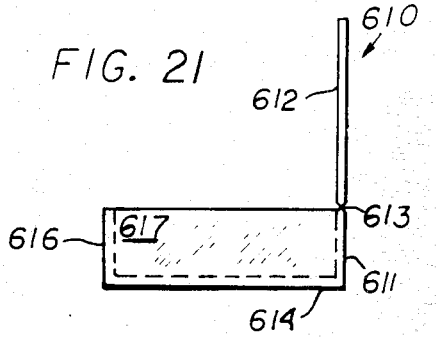
FIG. 23 is a side view of a box with a hinge according to the embodiment of the invention shown in FIG. 22, showing the box cover in intermediate position.

The bow can be molded in a two piece mold in the position shown in FIG. 22.

Figure 26:
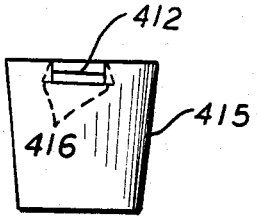
FIG. 26 is a front view of another embodiment of the invention showing the hinge used as a lid on a closure.
Figure 27:
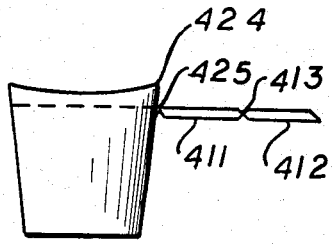
FIG. 27 is a side view of the embodiment shown in FIG. 25 with the lid member and closure shown in molding position.
Figure 28:
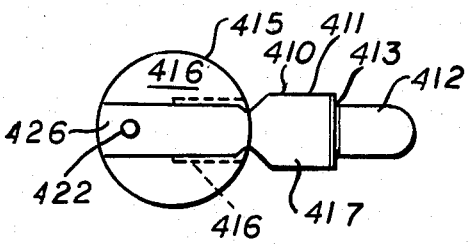
FIG. 28 is a top view of the closure shown in the position of FIG. 27.
Figure 29:
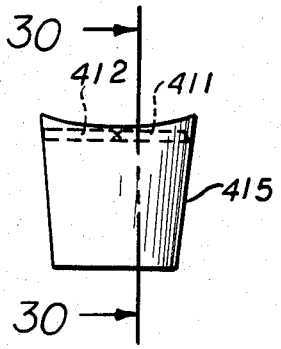
FIG. 29 is a side view of the closure with the lid or hinge member in closed position.
Figure 30:
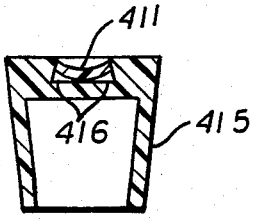
FIG. 30 is a cross sectional view taken on line 30—30 of FIG. 29.

Now with more particular reference to the embodiment of the invention shown in FIGS. 26 through 30, Applicant shows a hinge 410 used as the lid of a closure 415 which could be a cap for a bottle internally threaded for a cap. The cap has generally cylindrical side walls and a top 416 with a dispensing hole 422. The lid 410 is made up of a first lid member 411 and a second lid member 412. It will be noted that the top 416 has a slot 426 which is undercut as best shown in FIG. 26 and the first lid member 411 is wider than the slot 426. The lid member 411 will be bowed downward in the shape of an inverted cylinder as shown in FIG. 30 which will transmit a force through integal hinge 413 and a distortion into the second hinge member 412. This distortion will be in the form of a bow having its radius of curvature perpendicular to the bottom of slot 426. The hinge member 412 will be biased toward the open or closed position like the hinge in the embodiment of FIGS. 1 through 6. Thus when the hinge members are swung to the position shown in FIGS. 26 and 29 from the molding position shown in FIGS. 27 and 28, the first lid member 411 will be biased toward the closed position as shown in FIGS. 29 and 30. Then the distortion in the form of a curved hinge line 514 can be molded with member 511 flat with curved hinge end 512 will be in the shape of a part of a cylinder in first lid member 411 introduced into the second lid member 412 will be biased member 412 toward the position shown in FIG. 29, forces will be developed in the hinge members which will bias the second hinge member 411 either to an open position or to a closed position. When swung to the second position shown in FIG. 18 member 512 will be curved as in FIG. 17 but the opposite side of member 512 will be up. That is the curvature of member 512 will be reversed. The closure and lid can be molded as one integral piece in a two piece mold in the position shown in FIGS. 27 and 28. The lid parts 411 and 412 will be molded flat and member 411 will be bowed when closed and forced into slot as shown in FIG. 30.

Figure 17:
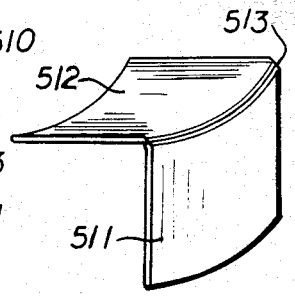
FIG. 17 is a side isometric view of the embodiment of the hinge shown in FIGS. 15 through 18 in molding position.

Now with reference to the embodiment of the invention shown in FIGS. 15 through 18 Applicant shows a two-part hinge 510 per se according to the invention made up of a first hinge member 511 and a second hinge member 512. The first hinge member 511 and the second hinge members 512 are hinged together by the integral hinge 513 along the hinge line 514. The first hinged edge of member 511 is molded with its hinged end bowed in the arc of a circle having its radius parallel to the member 511. The hinge 510 is shown in FIG. 17 in its shape in which it will be received in the injection mold it has its second hinge member 512 molded in the form of a part of a cylinder of radius perpendicular to its surface. When the hinge member 510 is removed from the mold and swung to the position shown in FIGS. 15 and 16, the hinge member 512 will be bowed in the opposite direction to the bow shown in FIG. 17. Thus FIG. 17 shows a first position, FIG. 18 a second position and FIG. 15 and FIG. 16 an intermediate position. When in an intermediate position with the two hinge members 511 and 512 in parallel relation as in FIG. 16, the curved hinge line of the hinge member when molded will be somewhat straightened by the forces exerted by the plate like hinge members on each other and hinge member 512 will be warped somewhat like the hinge member in FIG. 24.

Figure 18:
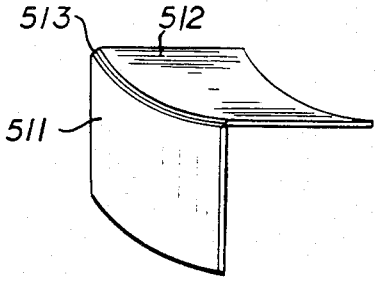
FIG. 18 is a side isometric view of the hinge shown in FIGS. 15, 16 and 17 with one hinge member swung 180° from the position shown in FIG. 17.

The internal forces of the two distorted hinge members will bias the hinge member 512 relative to the hinge member 511 either to the position shown in FIG. 17 or the position shown in FIG. 18. This hinge shown in FIGS. 15 through 18 can be used in a variety of applications where a biased hinge is required.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A hinge including a swingable portion, a reference portion, and a reduced connecting portion between said swingable portion and said reference portion, said reduced connecting portion being integral with said swingable portion and said reference portion and extending continuously between a first point and a second point in a manner such that said reduced connecting portion follows a path which is displaced from a straight line connecting said first and second points whereby upon swinging said swingable portion about said reduced connecting portion said swingable portion swings through an intermediate position such that on either side of said intermediate position said swingable portion is urged away from said intermediate position.

2. The hinge of claim 1 wherein on one side of said intermediate position said swingable portion is urged into a first bowed configuration and on said other side of said intermediate position said swingable portion is urged into a second bowed configuration, said first and second bowed configurations comprising configurations bowed on opposite sides of the plane of said swingable portion.

3. The hinge of claim 1 wherein said swingable portion, said reference portion and said reduced connecting portion comprise molded plastic.

4. The hinge of claim 1 wherein said swingable portion comprises a closable portion for a container and said reference portion comprises at least a portion of one wall of said container.

5. The hinge of claim 1 wherein said intermediate position comprises said swingable portion and said reference portion being generally located in a common plane.

6. The hinge of claim 1 wherein said path lies substantially in the plane of said reference portion.

7. The hinge of claim 1 wherein said path lies substantially perpendicular to the plane of said reference portion.

8. The hinge of claim 1 including urging means for urging said reduced connecting portion into said path displaced from a straight line connecting said first and second points.

9. The hinge of claim 8 wherein said urging means comprises reference portion deforming means for deforming said reference portion into a substantially arcuate configuration.

10. The hinge of claim 9 wherein said reference portion deforming means comprises pintle means attached to said reference portion.

11. The hinge of claim 1 wherein said swingable portion, said reference portion and said reduced connecting portion comprise thermoplastic material.

12. The hinge of claim 1 wherein said swingable portion, said reference portion and said reduced connecting portion comprise thermosetting material.

13. The hinge of claim 1 wherein said swingable portion and said reference portion each comprises a substantially planer plate portion, and at least one of said substantially plate portions is bowed.

14. The hinge of claim 13 wherein said at least one of said substantially planer plate portions is bowed substantially in the form of a portion of a cylinder.

15. The hinge of claim 13 wherein both of said substantially planer plate portions are bowed.

16. The hinge of claim 15 wherein both of said substantially planar plate portions are bowed substantially in the form of a portion of a cylinder.

17. The hinge of claim 1 including a reference hinge member attached to said reference portion whereby said reference portion may be caused to swing about said reference hinge member between first and second reference portion positions.

18. The hinge of claim 17 wherein said reference hinge member is integral with said reference portion.

19. The hinge of claim 17 wherein said swingable portion, said reference portion and said reduced connecting portion form the lid for a container.

* * * * *